US006101985A

United States Patent [19]

Bude et al.

[11] Patent Number: 6,101,985

[45] Date of Patent: Aug. 15, 2000

[54] WATER LANCE BLOWER WITH SHORTENED WATER LANCE

[76] Inventors: Friedrich Bude, Chopinstrasse 24, D-03050 Cottbus; Karl Albers, In der Luft 15, D-46485 Wesel; Stephan Simon, Birkenweg 9a, D-46499 Hamminkeln, all of Germany

[21] Appl. No.: 08/978,733

[22] Filed: Nov. 26, 1997

Related U.S. Application Data

[63] Continuation of application No. PCT/EP96/02326, May 30, 1996.

[30] Foreign Application Priority Data

May 30, 1995 [DE] Germany ..... 195 19 790

[51] Int. Cl.[7] ..... F22B 37/52

[52] U.S. Cl. ..... 122/379; 122/390; 122/392; 122/405

[58] Field of Search ..... 122/379, 390, 122/392, 405; 15/246.5

[56] References Cited

U.S. PATENT DOCUMENTS

| | | | |
|---|---|---|---|
| 1,931,272 | 10/1933 | Snow . | |
| 4,539,588 | 9/1985 | Ariessohn et al. . | |
| 5,237,718 | 8/1993 | Brown | 122/390 |
| 5,337,441 | 8/1994 | Miyamoto et al. | 122/390 |
| 5,765,510 | 6/1998 | Krowech et al. | 122/390 |

FOREIGN PATENT DOCUMENTS

| | | |
|---|---|---|
| 637-931 | 5/1928 | France . |
| 600 827 | 7/1934 | Germany . |
| 145 475 | 12/1980 | Germany . |
| 145 476 | 12/1980 | Germany . |
| 155 857 | 7/1982 | Germany . |
| 234-479-A1 | 4/1986 | Germany . |
| 239-656-A1 | 10/1986 | Germany . |
| 276-335-A1 | 2/1990 | Germany . |
| 276-908-A1 | 3/1990 | Germany . |
| 281-448-A5 | 8/1990 | Germany . |
| 281-452-A5 | 8/1990 | Germany . |
| 281-468-A5 | 8/1990 | Germany . |
| 41 39 718 A1 | 12/1991 | Germany . |
| 41 39 838 A1 | 12/1991 | Germany . |
| 41 42 448 A1 | 12/1991 | Germany . |
| 33 43 992 C2 | 12/1993 | Germany . |
| 44 15 010 A1 | 4/1994 | Germany . |
| WO 93/12398 | 6/1993 | WIPO . |

OTHER PUBLICATIONS

International Search Report PCT/EP96/02326.

Preliminary Examination Report PCT/EP96/02326.

Stein, Dipl.–Ing. J., Induktives Wegmeβsystem, *Steuerungs–Und Regelungstechnik*, 1988, No. 10, pp. 702–704.

*Primary Examiner*—Denise L. Ferensic
*Assistant Examiner*—Gregory A. Wilson
*Attorney, Agent, or Firm*—R. William Beard, Jr.; Frohwitter

[57] ABSTRACT

A water lance blower for cleaning heating installations, wherein a water lance (6) is movably (5) arranged with its mouth on or in a hatch (2) and can blow a water jet through the heating installation, which is in operation and is flowed through with flames and/or smoke, onto wall areas (A–E) which can be reached from the hatch (2), wherein the water lance (6) is configured in a shortened manner, in that the water supply (11, 10) is bent one or more times by in total more than 70°, preferably more than 90° (20, 24; 39). In addition steadying of the flow profile is effected by an expanded calming volume (20) arranged in the end of the water lance (6) lying outside the heating installation, in particular an approximately spherical volume (20), so that the jet quality of the water lance is not impaired. The shortened water lance permits more simple drive mechanisms and adjustment to restricted spatial arrangements.

16 Claims, 7 Drawing Sheets

WATER LANCE BLOWER WITH SHORTENED WATER LANCE

CONTINUATION STATEMENT

This is a continuation of International Application Number PCT/EP96/02326 designating the United States filed May 30, 1996, still pending.

BACKGROUND OF THE INVENTION

The present invention relates to a water lance blower for cleaning a heating installation having wall areas and a hatch, wherein the heating installation is operational with flames and/or smoke flowing therethrough.

The cleaning of heating installations, in particular of furnaces of high powered steam boilers during operation takes place inter alia with the aid of water lance blowers, which supply a focused water jet through the furnace onto the wall lying opposite. As a result of the thermal shock occurring, the kinetic water jet energy and of the sudden vaporisation of water forced into the pores of the deposits, peeling off of the dirt composed of rust, slag and ashes is effected. Typical arrangements and the associated field of such water lance blowers are described, for example, in DD 276 335 A1, DD 281 452 A5 and DD 281 468 A5.

The water jet from water lance blowers generally follows a specific predetermined path onto the surface to be cleaned, also known as the blowing pattern, wherein this path is generally wave-form or spiral and where appropriate avoids obstacles, apertures or other sensitive areas.

In addition to control of the drive systems by means of a template, which inevitably produces a very specific blowing pattern, mainly dual axis controls are used, with axes of control at right-angles to one another, in particular a horizontal and a vertical axis, in order to be able to control wave-form paths particularly easily. In this manner, it was always possible until now to produce specific wave-form blowing patterns purely by means of time control or control of the individual axial drives from a minimum impact to a maximum impact. This type of control makes it necessary, however, to align the drive system as precisely as possible as is described, for example, in DD 234 479 A1. Here, two actuating elements act upon the water lance, wherein these two actuating elements are arranged at an angle of 90° on a frame, wherein in addition the fixing points of the actuating elements must lie in a plane with the point of movement of the water lance.

A further dual axis control is also known from WO 93/12398, which precisely controls the water lance by means of two spindle mechanisms running perpendicularly to one another.

It is also known from DD 239 656 A1 to control the cleaning parameters of a water lance blower by means of temperature measurements of the surface to be cleaned.

Lastly, it is also known from DE 33 43 992 C1 that water lance blowers can be provided with a housing, in order to prevent uncontrolled gas exchange through the hatch and to protect the water lance and movable parts from soiling.

The previously known water lance blowers have the disadvantage that guidance of the blower lance takes place by means of complex mechanisms and central drives, wherein in the space around the blowing guides drive and bearing elements are supported and arranged in a frame construction, take up a large amount of space and inhibit the ability of the lance to move and allow the supply of water only from the rear. Consequently there is a long water supply path with a hose connection which inevitably has to be connected from the rear to the end of the blower pipe. The consequently necessary large length of the lance and the water supply leads to high degrees of leverage and forces which in turn necessitate appropriate guides, drives and frames.

In addition there is not always enough space available in every hatch in which a water lance blower ought advantageously to be arranged. Numerous interior components, such as steam pipes, switchgear cupboards, working platforms and so forth, impede the attachment of large rectangular frameworks.

SUMMARY OF THE INVENTION

The object of the present invention is therefore to provide a shortened construction for a water lance blower which can be arranged flexibly even where there are restricted spaces, and in addition places few demands on the stability of the drive system, and allows free choice of any blowing patterns and any speeds of movement.

This object is solved by a water lance blower for cleaning a heating installation having wall areas and a hatch, wherein the heating installation is operational with flames and/or smoke flowing therethrough, said water lance blower comprising: a water lance having a mouth, wherein the water lance is movably arranged with the mouth at the hatch for blowing a water jet through the heating installation onto the wall areas which can be reached from the hatch, wherein the water lance is configured in a shortened manner; and a water supply which supplies water to the water lance, wherein the water supply comprises at least one first bend, wherein the at least one first bend is at least 70°.

A significant shortening of the overall length of a water lance is obtained in that the water supply is bent once or several times by more, in total, than 90°. It was previously known to configure the water supply with an obtuse angle in order, for example, to lead in a hose at an angle from the rear, however deflectors of 90° or more were not possible with previous drive systems as the hose would then have collided with the drive elements. Angled water supplies according to the invention have the advantage, however, that the water supply is closer to the point of movement of the water lance, whereby the force necessary for moving the water lance is considerably reduced because of the shorter leverage effected by the heavy water hose. The water supply can, according to the invention, be shifted close to the point of movement and the outside wall of the heating installation, whereby much shorter paths are necessary for the water supply when the water lance is moved. These advantages also permit less stable drive systems to be used as smaller forces are required. Such drive systems can be produced without surrounding frames, whereby the water supply close to the wall can lead without any problems into an area without driving elements.

According to how short the water lance is, the last bend in the water supply can affect the quality of the water jet leaving the water lance. This is alleviated by an equalising volume, in particular a substantially spherical equalising volume, on the rear end of the shortened water lance. By means of such a volume, the flow profile of the water flowing via a bend is evened out and consequently good focusing of the water jet in the water lance is produced again.

A shortened water lance blower according to the invention is particularly preferably movable by means of very simple mechanisms, for example, by at least one movement element which is fixed in a stationary manner to the heating installation by one end outside a vertical plane through the movement point of the water lance to the heating installation and by the other end to the water lance. In addition, the drive system is equipped with path sensors for precise determination of the position of the water lance, whereby a regulated manner of operation can be implemented. The arrangement of one or more movement elements outside a vertical plane through the point of movement of the water lance, allows this point of movement to be shifted far forward into the hatch or the heating installation, whereby larger slewing ranges and more advantageous leverage behaviour are produced with the drive system. If only one movement element is used, it must be able to be altered in its length and in its direction, that is to say approximately fulfil the functions of a manipulator arm. If two movement elements are present, they need only to be provided with drives for length in order to move the water lance along any paths.

Nevertheless, with two movement elements it may happen that they almost come into a position of alignment, whereby driving of the water lance is no longer possible, or is very difficult. For such arrangements, a third movement element which can then support the driving is very important. According to the requirements for the precision of the movement and the stability of the system, more than three movement elements can also be used.

Common to all the arrangements described is that, for example, for carrying out a wave-form blowing pattern, highly complex, non-linear movements of the movement element or elements are necessary so that a simple control, in particular a time control, can no longer be considered for such arrangements.

For this reason the drive system according to the invention is provided with path sensors for precise determination of the position of the water lance, so that now there is no longer elementary control but instead regulated control along a set line of movement is possible. The path sensors make possible the precise control of the blowing pattern so that the movement elements can be controlled accordingly. The drive system also allows certain parts of the blowing pattern to be gone over at a first speed and other parts of the blowing pattern, for example unsoiled or sensitive areas, at a second speed. Essentially any blowing patterns and any speed profiles can be programmed or memorised by location sensing.

The path sensors can either be arranged in the movement elements themselves, as typical path or angle sensors, or they can be arranged on one or more path sensor arms. It is important that they can measure the exact position of the water lance with respect to a reference position which can, where appropriate, be determined before the beginning of the blowing procedure. Capacitive, inductive or magnetic measuring sensors, as well as digital signal element counters and the like are suitable as path sensors.

Control takes place in a shared electronic control system, which receives the measured values of the path sensors, compares them with the set values of the pre-determined blowing pattern and controls the movement elements accordingly. In this way, whatever the spatial arrangement of the movement element or elements, blowing patterns can be repeated exactly with respect to path of travel and speed. The movement elements can, for example, be hydraulic or pneumatic lifting cylinders, or known spindle or rack and pinion drives or also electrical or magnetic drive systems or use of a manipulator arm is possible. According to the space available it can also be advantageous to adapt the movement elements with levers, cable pulls, chains, rotary joints and the like to the spatial conditions.

In order to improve the availability of the system and the positioning precision and the reproducibility of a blowing pattern, it is possible to provide at least one path sensor more than is in principle necessary for determining the position. By means of error compensation, inaccuracies of the path sensors can be reduced and the driving of the equipment of possible, even when a path sensor fails.

A method for operating the system according to the invention is that the installation is assembled in place and then the blowing pattern is initiated for the first time using a template or visual observation of the water jet and the associated measured values of the path sensors are memorised. Calculation of the set values for the path sensors for any blowing pattern is possible, after the measured values of the path sensors have been sensed for a particular reference point.

The invention also allows almost any arrangement of the movement elements according to the local conditions, wherein the control of the movement elements by path sensors makes possible the precise tracking of predetermined blowing patterns with predetermined speed profiles despite the necessarily complicated coordinate transformations.

BRIEF DESCRIPTION OF THE DRAWINGS

The associated field of the present invention and different embodiments for explaining it will be described with reference to the following drawings.

Figure 2:
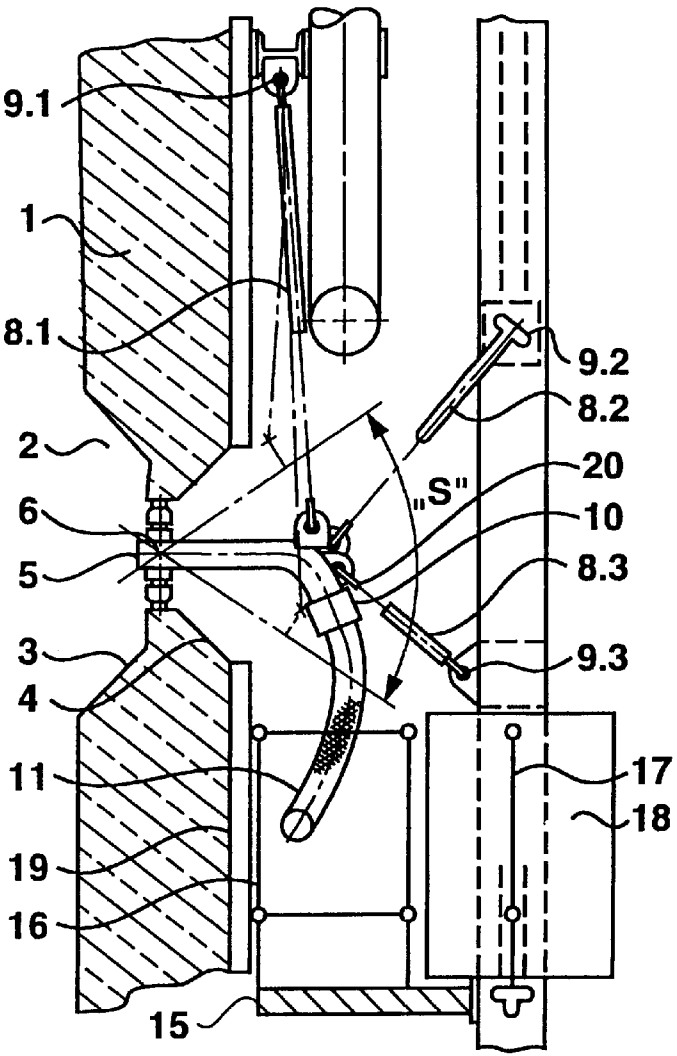
FIG. 2 is a horizontal section through the wall of the heating installation in the plane of the water lance blower.

It is to be noted, however, that the appended drawings illustrate only typical embodiments of this invention and are therefore not to be considered limiting of its scope, as the invention may admit to other equally effective embodiments.

DETAILED DESCRIPTION OF THE INVENTION

The embodiments in FIGS. 1 to 5 serve firstly to illustrate the arrangements of water lance blowers according to the invention. In the wall 1 of a heating installation there is located a hatch 2 with angled pieces towards the inside 3 and the outside 4. In the hatch 2 there is located the movement point 5 of the water lance 6 in the form of a swivel bearing or ball joint for the water lance 6 attached in a fixed manner to its centre. The water lance 6 is provided at the rear end with fixing points 7.1, 7.2, 7.3 in which the lance-side ends of the movement elements 8. 1, 8.2, 8.3 are rotatably mounted (but not moveable on the lance). The rearward ends of the movement elements 8.1, 8.2, 8.3 are rotatably integrated into the locating bearings 9.1, 9.2, 9.3, for example ball joints. The entry of water into the lance 6 is via a connector 10 and a water supply 11 in the form of a pressure resistant flexible hose.

In reality, the heating installation is surrounded by numerous components impeding the fitting of water lance blowers. For example, above the hatch 2 a steam pipe 13 and the locating bearing 9.1 are fixed on a first support 12. A second support 14 is arranged at a short distance away to the right adjacent to the hatch 2. To the right of this a grating floor, serving as a working platform, terminates. The second support 14 also delimits the rails 16 and 17 and the footway and working platform 15 and supports a switchgear cupboard 18.

The end of the lance can be pivoted by means of its movement elements 8.1, 8.2, 8.3 in the slewing range S vertically from above "o" to below "u" and in its horizontal range from left "l" to right "r".

Because of the obstacles a frame arrangement would not be feasible in this area.

Because of the small distance apart of the steam pipe 13 and the outer skin 19 of the wall 1, there is very limited space available which, although allowing large vertical paths from the top "o" to the bottom "u" lance position in the working area "S", only permits minimal paths in the horizontal direction between the outer skin 19 and the steam pipe 13. Because of the obstacle constituted by the switchgear cupboard 18, the locating bearing 9.3 can only be fitted above it and has to be fitted onto the outermost right hand edge of the support 14 because of the necessarily large almost horizontal paths in the working area S from right hand bottom ("r"/"u") to left hand bottom ("l"/"u") and left hand top ("l"/"o"), whereby a long movement element 8.3 is also necessary. Where there are pre-determined controlled distances apart between the points 9.1–7.1 and 9.3–7.3, every position of the lance is clearly fixed, together with the front swivel bearing of the lance. Obtuse angles with increased forces only occur in the working area "r"/"o". In accordance with the invention a third, but short, movement element 8.2 is installed between points 7.2 and 9.2 which is controlled at the same time by its spacings and prevents an oscillating and jerky type of movement of the lance (6) and of the water jet.

The spacers 8.1 to 8.3 work in the top and on the outer right hand edge area of the working platform, and thereby do not impede access to the platform and allow sufficient space downwards and to the left for an elbow bend 20 to be attached to the water connector 10 directly behind the very short lance length required for the quality of the blown jet, and for the water supply 11 to be arranged to the left near to the wall. In this way it is firstly possible to have a smaller pivoting path for the flexible hose, and secondly it is possible to have access to the platform 15 as far as the blower, even during the blowing operation, without hindrance.

Figure 1:
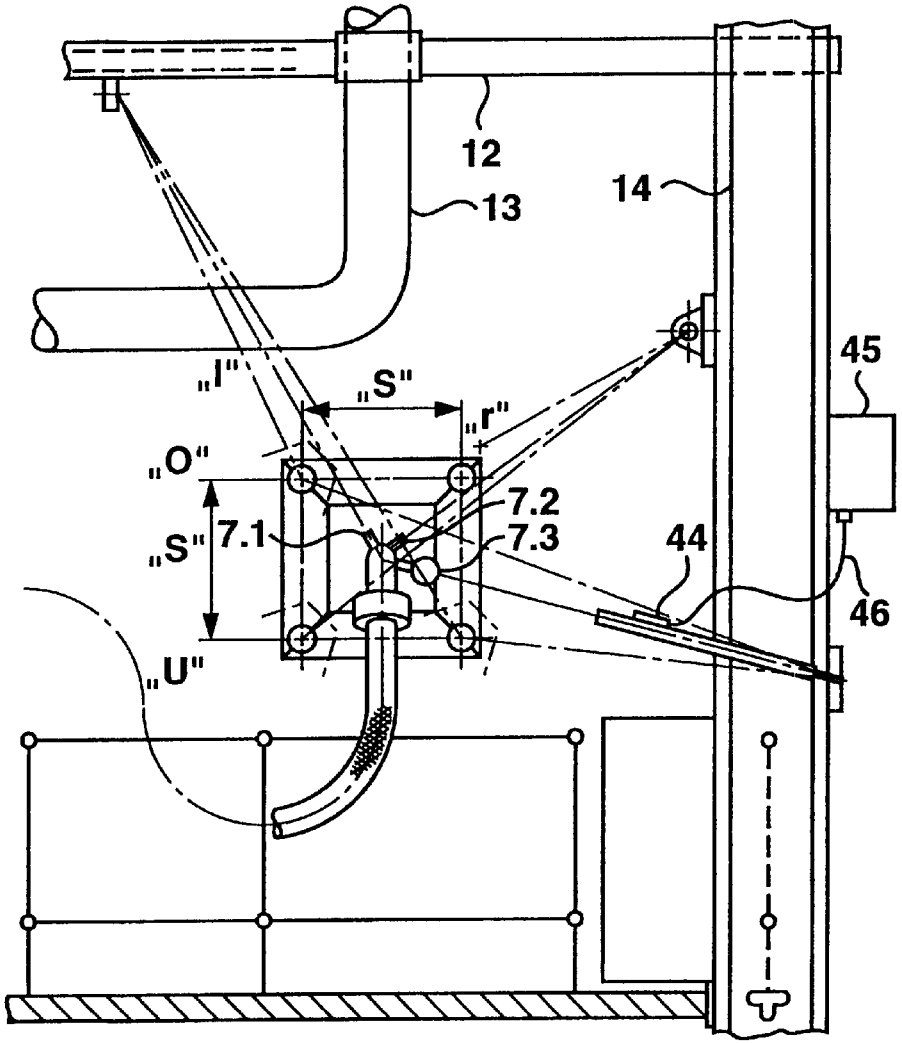
FIG. 1 is a view from the outside of a water lance blower in a hatch of a heating installation.

In FIG. 1, on the movement elements 8.1 to 8.3, there are located control elements, which are not shown, which set the lengths of the movement elements according to the predetermined blowing pattern and the measured values of the path sensors 44, which are also not shown, of the position of the water lance. In all the working positions of the lance, each movement element 8.1–8.3 carries out a change in length and speed of change in length dependent upon the spatial geometry of the distances, angular arrangements and the geometric location of the mountings 7.1–7.3 and locating bearings 9.1–9.3, which mutually effect the movement of the lance and the guiding of the water jet.

In an embodiment according to the invention, after mounting of the water lance blower, the geometry between the movement point 5, the fixing points on the water lance 7.1–7.3 and locating bearings 9.1–9.3 is measured, the results input into a computer program and the change in each movement element memorised there according to the blowing location and/or the blowing time for pre-determined blowing patterns, and during operation is transferred via the control elements to the movement elements.

In a further embodiment, during the setting-up phase for the working areas, the distances of the movement elements beyond the primary movement of the lance or a stop, which is not shown, on the end of the lance, which is mechanically coupled to a device for setting the blowing path, can be set. The changes in length of the individual movement elements resulting from each movement of the setting-up device and stop are registered and memorised by the path sensors. Any blowing patterns can therefore be predetermined using the setting-up device.

After removal of the setting-up device and the initialising of the control and water 10 blowing, the movements memorised are started.

The solution according to the invention will hereinafter be described in detail with reference to an example: The water lance blower according to FIG. 1 should, after assembly, when the lance is in a centred position, have axially at the point of movement 5 the following geometrical dimensions for the setting-up of the movement elements 8.1–8.3, its locating bearings 9.1–9.3 and points of fixation 7.1–7.3 on the water lance 6 with respect to the central point of rotation of the pivoting device 5, which is determined as the geometric point 0 (FIGS. 4 and 5):

| | Geometric point | | |
|---|---|---|---|
| Rotation point of part no. | X | Y | Z |
| 5 | 0 | 0 | 0 |
| 7.1 | $X_{7.1}$ | $Y_{7.1}$ | $Z_{7.1}$ |
| 7.2 | $X_{7.2}$ | $Y_{7.2}$ | $Z_{7.2}$ |
| 7.3 | $X_{7.3}$ | $Y_{7.3}$ | $Z_{7.3}$ |
| 9.1 | $X_{9.1}$ | $Y_{9.1}$ | $Z_{9.1}$ |
| 9.2 | $X_{9.2}$ | $Y_{9.2}$ | $Z_{9.2}$ |
| 9.3 | $X_{9.3}$ | $Y_{9.3}$ | $Z_{9.3}$ |

Figure 5:
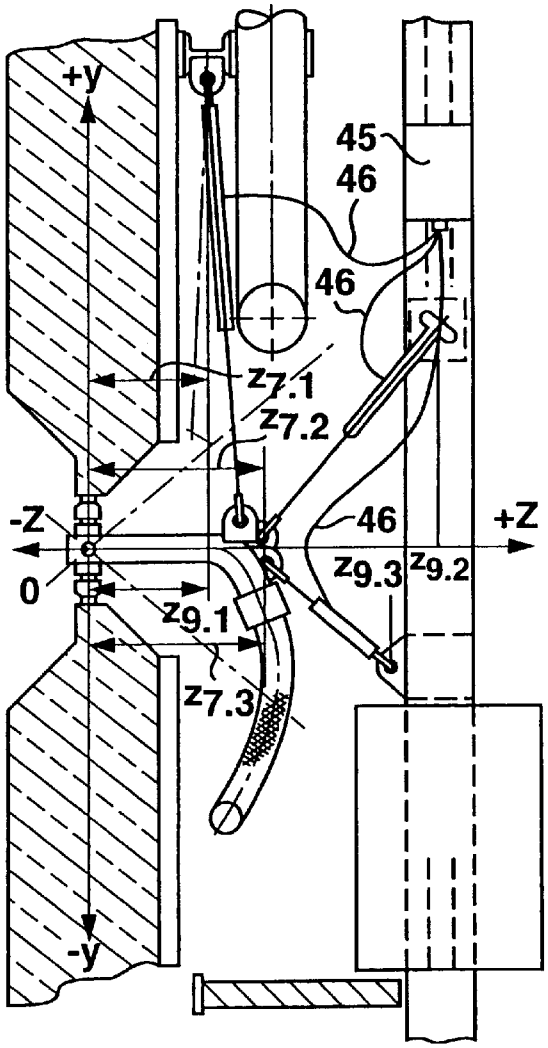
FIG. 5 is a view of the embodiment from FIG. 2 with axes of movement indicated.
Figure 4:
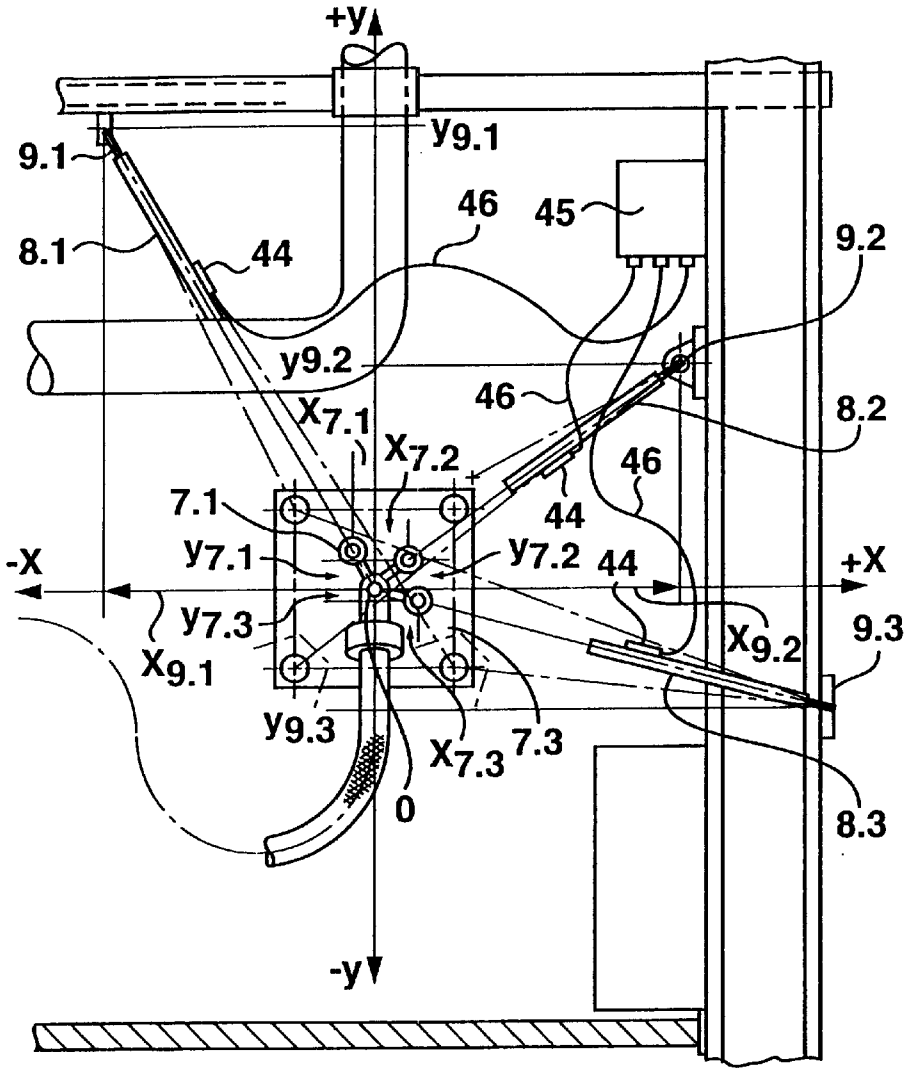
FIG. 4 is a view of the embodiment shown in FIG. 1 with axes of movement indicated to explain the course of movement.

Naturally, the coordinates shown in FIGS. 4 and 5 and the above table only apply to point rotational points, for example in the form of a ball joint. In the simplified solution shown in FIGS. 1,2 and 4,5 with eye and annular shaped connecting elements, possible corrections may still have to be made for the point of rotation.

These are decided by testing, however, as there is a necessary range of tolerance with all mechanical movements of the movement elements.

The coordinates of the wall area to be cleaned and the limits thereof are determined by means of the point of rotation with the coordinates X; Y; Z=0, the point of movement 5, such that the geometrically straight line (where appropriate after ballistic correction for large distances) of the water jet of the lance 6 onto the wall surfaces of the heating installation determines the geometrical point on the wall (for each associated lance position).

Figure 3:
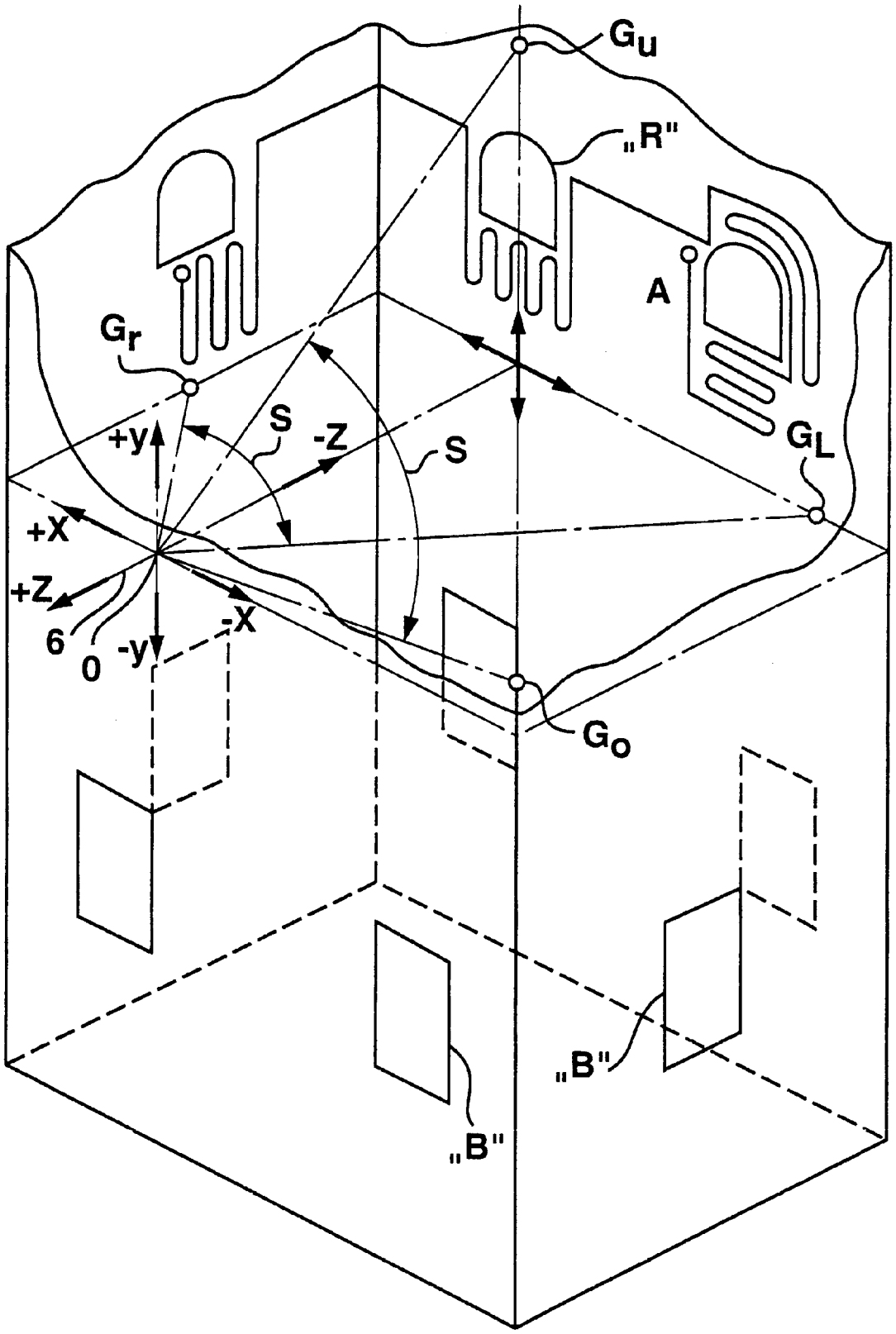
FIG. 3 is a schematic of the mode of operation of a water lance blower in a heating installation.

FIG. 3 shows the geometry of a part of a combustion chamber. In the lower part are located six burner apertures B, in the upper part six smoke recirculating apertures R. The mounted arrangement of a water lance 6 according to FIGS. 4, 5 is shown with its geometric point 0 indicated. The plane Y=0 produces the blowing limits on the combustion chamber walls from $G_r$, the horizontal blowing area S to $G_l$, the plane X=0 produces the limit point $G_u$ from $G_o$ above S (above, right and so forth are logically arranged in mirror image to FIGS. 4, 5). Any further point on the wall in the combustion chamber can be associated geometrically with coordinate of the lance position. In a preferred embodiment this is done geometrically using the combustion chamber dimensions available, for example by means of a mathematical program.

In an alternative embodiment characteristic points of the combustion chamber wall are determined by means of local measurement, for example by means of laser beams replacing the lance provided which are used when the boiler is at a standstill (naturally, with this the length and crosswise expansion of the wall surfaces during operation of the boiler must be taken into account) or other suitable measuring devices during constant operation.

In an analogous manner blowing paths for the surface areas to be cleaned are determined geometrically by mathematical or measuring techniques and are input into the control system for the movement elements. An example of this is the blowing patterns shown in FIG. 3 for cleaning the slag formations below some waste gas recirculations R and above a waste gas recirculation. The cleaning programme begins at A and ends at E. The mode of working is such that after programming of the associated path-time diagrams, for example in the computer or unit controller data store, after input of the corresponding cleaning command the water lance blower travels into the position A (FIG. 3) and with opening of the water supply the path-time program of the movement elements 8.1–8.3 is carried out as far as point E and there the water supply shuts off again.

Figure 7:
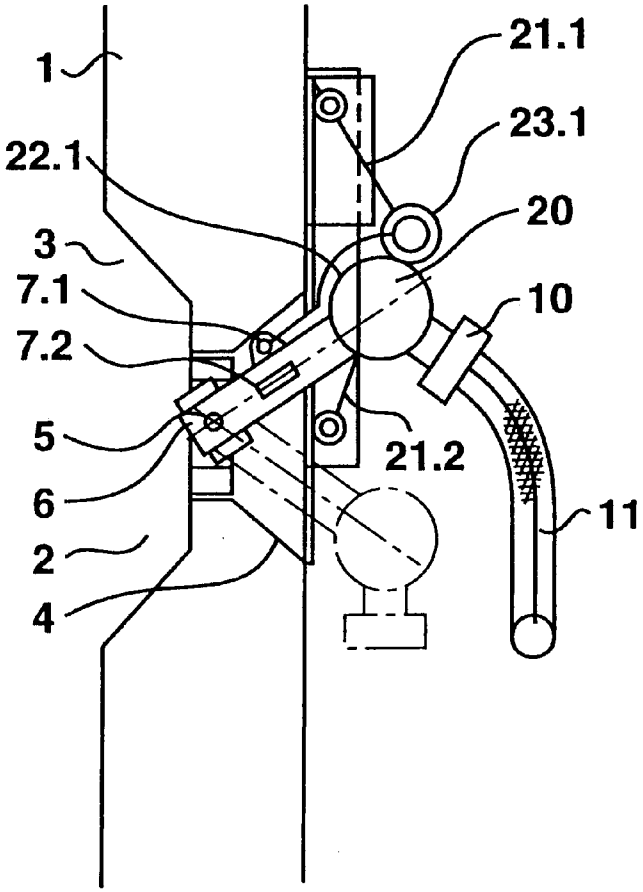
FIG. 7 is a view of a longitudinal section through the shortened water lance.
Figure 6:
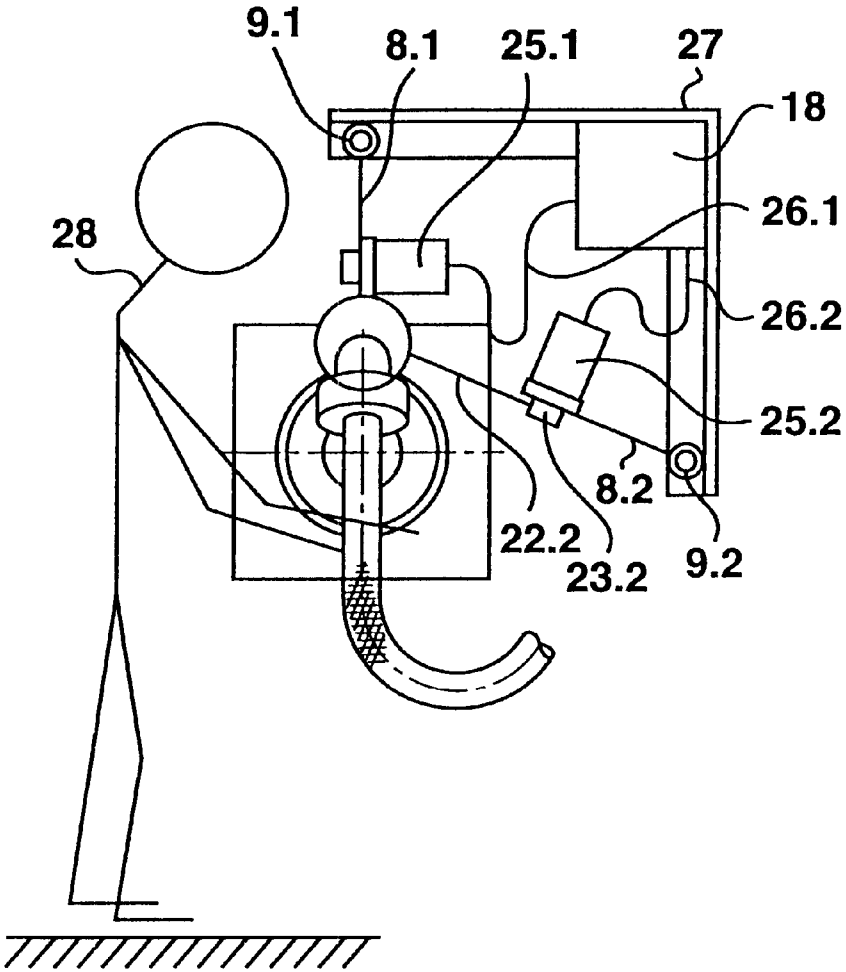
FIG. 6 is a view from the rear of a shortened water lance with equalising volumes.

FIGS. 6 and 7 show, as a further embodiment, a shortened and therefore particularly easily movable water lance blower with 2 angled arms, frame and a control apparatus. In the wall 1 of the heating installation there is located the hatch 2 with angled pieces towards the inside 3 and outside 4. In the hatch 2 the point of movement 5 of the water lance 6 is installed in a fixed manner and is configured as the front swivel bearing for the water lance 6 fixed to the centre. The lance 6 is provided as the rear end with fixing points 7.1, 7.2 in which the lance-side ends of the movement elements 8.1, 8.2 are rotatably fixed. The rearward end of the movement elements 8.1, 8.2 is rotatably integrated into the locating bearings 9.1, 9.2. The entry of water into the lance takes place via a connector 10 and a water supply 11 in the form of a pressure resistant flexible hose.

The lance 6 and the water connector 10 are integrated into a spherical holder 20, which serves as a calming volume for the water flowing in laterally. The movement elements 8.1 and 8.2 are each composed of an upper arm 21.1 and 21.2 and a curved lower arm 22.1 and 22.1 adapted to the spherical shape of 20, which are connected to spindles 23.1 and 23.2.

The spindles are provided with drives 25.1 and 25.1 which run into the control cupboard 18 via flexible cable connections 26.1 and 26.2. The control cupboard 18 and locating bearings 9.1, 9.2 are fixed in a frame 27 which is arranged on the wall 1. In this embodiment of the water lance blower the entire construction can be fixed on a quarter of the surface, on one side above the hatch, using only a quarter frame and 2 movement elements 8.1 and 8.2, so the floor area and the left hand side are completely available for access by an operative 28.

The extremely short lance 6 is provided according to the invention at its end with a spherical container 20 which steadies the inflow conditions of the water supply 11 in the sphere and provides an even water flow to the water nozzle over the cross-section of the lance. With this arrangement of the movement elements 8.1 and 8.2, of the mountings 7.1 and 7.2 and the small type of construction, the leverages are small and the stability of the lance guidance is sufficient with 2 movement elements. Despite the small dimensions, with the outwardly bent lever system the spatial arrangement of the drives 25.1 and 25.2 and of the control cupboard inside the frame 26 is possible. Particular spatial minimisations are produced by the small distances between the point of rotation 0 and mountings 7.1 and 7.2 with the consequent small controlling movements of the arms 8.1, 8.2 and cable connections 26.1, 26.2.

Figure 11:
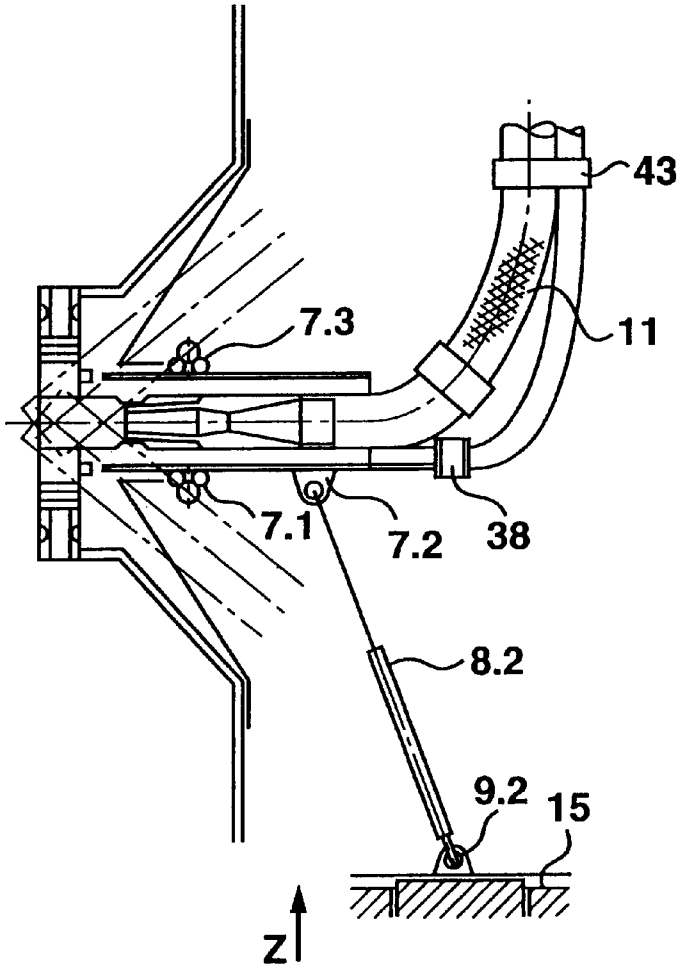
FIGS. 10 and 11 show further embodiments of drive systems of water lances.
Figure 10:
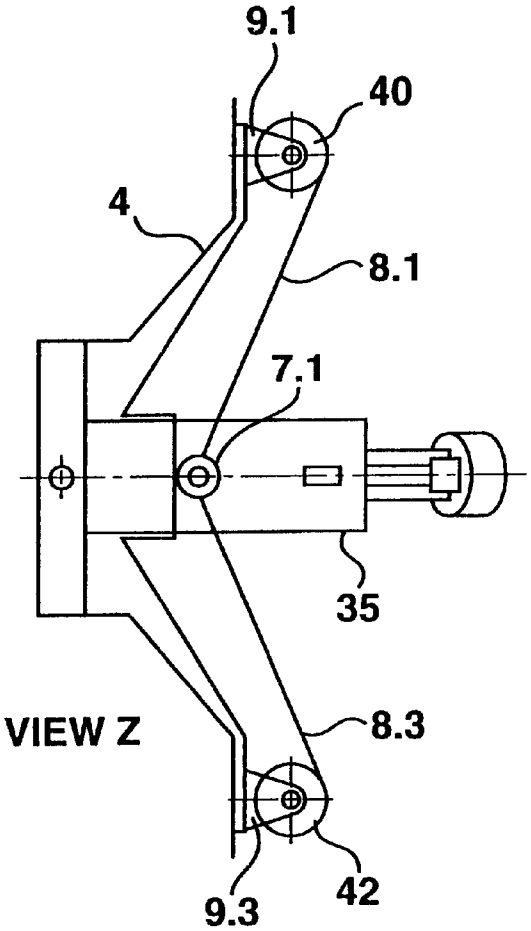

In a further solution problems of stability of the lance guidance by means of only 2 length controlled movement elements is overcome by an additional 1–2 non-controlled, tensioned movement elements which, for example, run as cables with a counter weight over rollers (see also FIGS. 10 and 11: Pos 8.2, 9.2, 29). The mode of operation is as described in the 1st example for FIGS. 1–4.

Figure 9:
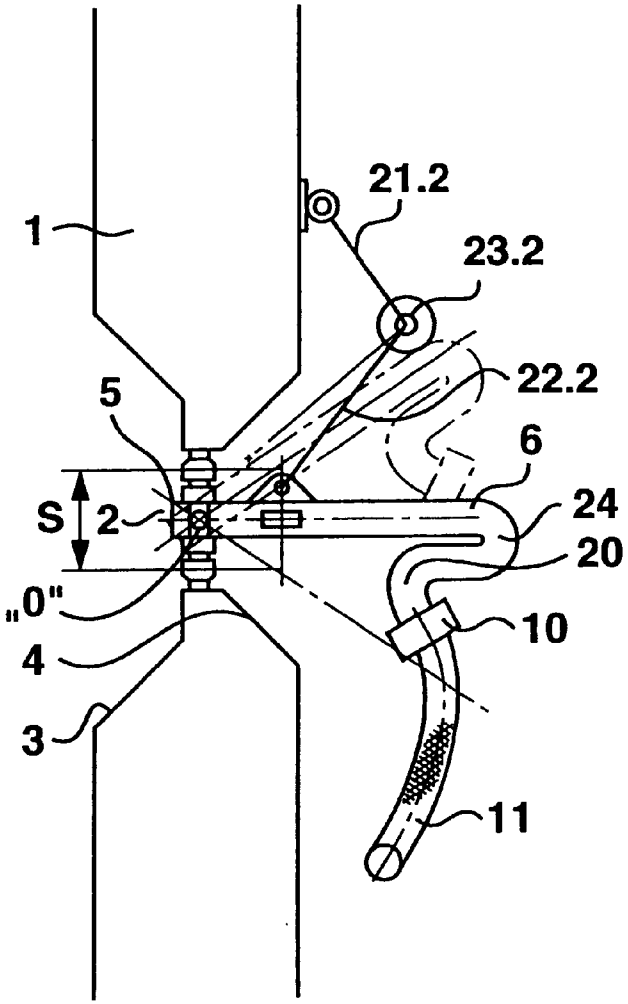
FIG. 9 is a view of a longitudinal section through the embodiment shown in FIG. 8.
Figure 8:
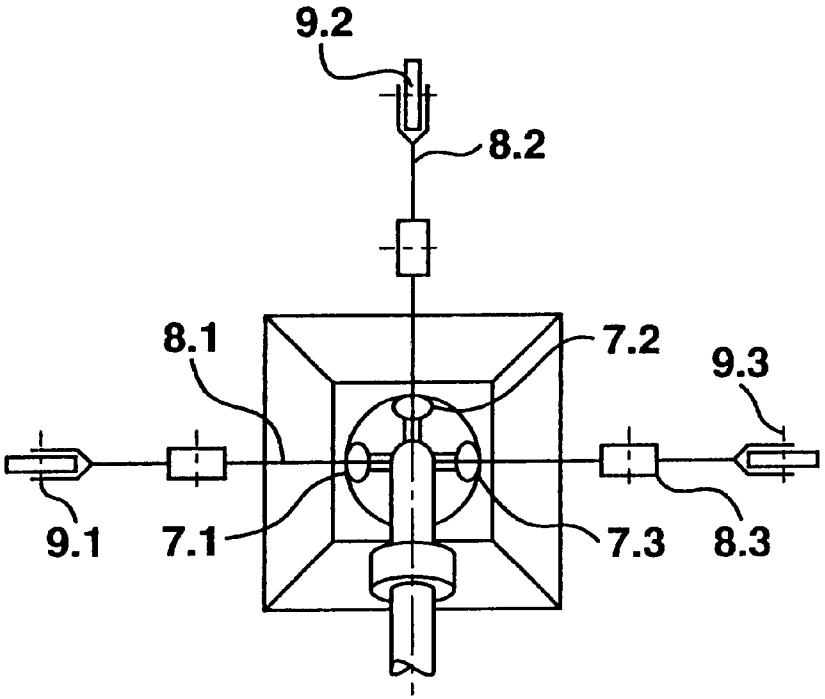
FIG. 8 is a view from the rear of a shortened water lance with three movement arms.

FIGS. 8 and 9 show another embodiment for the configuration and the drive of a 10 shortened water lance blower with 3 symmetrically arranged angled arms as the movement elements. In the wall 1 of the heating installation there is located the hatch 2 with angled pieces towards the inside 3 and outside 4. In the hatch 2 the point of movement 5 is installed in a fixed manner and is configured as the front swivel bearing for the water lance 6 fixed to the centre. The lance 6 is provided at the rear end with fixing points 7.1, 7.2, 7.3 in which the lance-side ends of the movement elements 8.1, 8.2, 8.3 are rotatably fixed. The rearward ends of the movement elements 8.1, 8.2, 8.3 are rotatably integrated into the locating bearings 9.1, 9.2, 9.3. The entry of water into the lance 6 takes place via a connector 10 and a water supply 11 in the form of a pressure resistant flexible hose. The movement elements 8.1–8.3 are each composed of an upper arm 21.1–21.3, lower arm 22.1–22.3 and each has a spindle 23.1–23.3, and are equipped with angular adjustment means, which are not shown. The water lance 6 runs at its rear end into a 180° deflector 24 which is connected to a bend 20. With this solution there is the advantage that by means of the kink in the upper arm-lower arm construction the fixing points 7.1–7.3 work in the proximity of the point of rotation 0 of the pivoting device, still inside the outer angled piece 4 and the path lengths of 7.1–7-3 in the working area S and consequently the angle of rotation of the spindles 23.1–23.3 is minimised.

In this way a further shortening, which is not shown, of the water lance blower 6 and also the reduction of the lower arm-upper arm system 21-23-22 is possible such that the locating bearings 9.1–9.3 can be fitted directly onto the rim of the outer edge of the outer angled piece 4 and the entire construction only slightly exceeds the measurement of the hatch and the necessary movements of the flexible hose of the water supply is further limited. The setting of the working areas is done in a manner analogous to that previously described. A change in the path is replaced by a change in the angle of rotation D alpha of the spindles 23.1–23.3.

FIGS. 10 and 11 show embodiments for water lance blowers with 2 tangentially fitted movement elements and a hydraulic cylinder.

The cable type movement elements 8.1 and 8.3, together with their locating bearings 9.1 and 9.3 and rolling means 42 are arranged approximately horizontally, but in contrast to the previous solutions are fixed by their mountings 7.1 and 7.3 on the tangential outside wall area of an outside pipe 35 of the water lance 6 inside the angled piece 4. The movement element 8.2 is arranged as a hydraulic cylinder with its locating bearings 9.2 on the support of the floor grating 15 and to the lance with its fixing point 7.2 in the proximity of the air supply 38. The air connector 38 and water connector 11 are configured axially towards the rear with bends facing upwards together in one direction.

This arrangement provides the following advantages:

short paths of the movement elements 8.1 and 8.3, thereby only small angles of rotation of the rollers 42.

improved effects of force by tangential retention 7.1 and 7.3, in particular with a large diameter of the outside pipe 35 when there is air cooling (air supply).

simplified common medium supply of water/air connected by a hose clamp 43, with the smallest space requirement.

reliable guidance despite the cable action 8.1 and 8.3 and by means of a hydraulic cylinder 8.2

Figure 13:
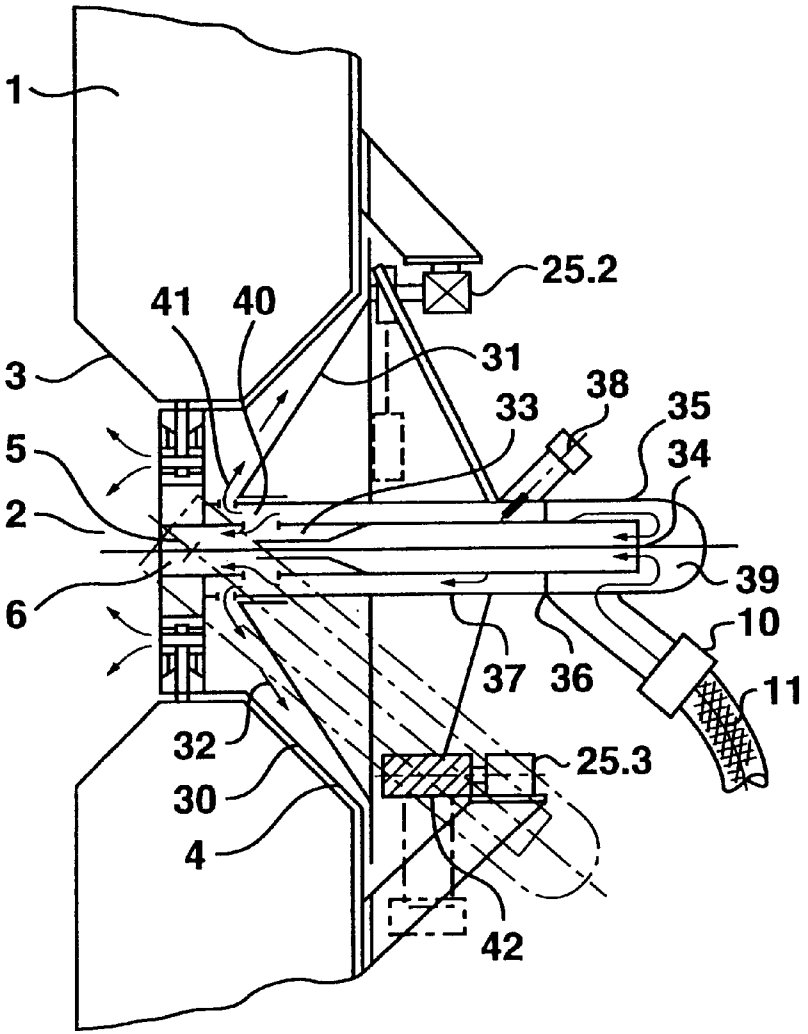
FIGS. 12 and 13 show a water lance with boxes for blocking and flushing mediums in the view from the rear and in a longitudinal section.
Figure 12:
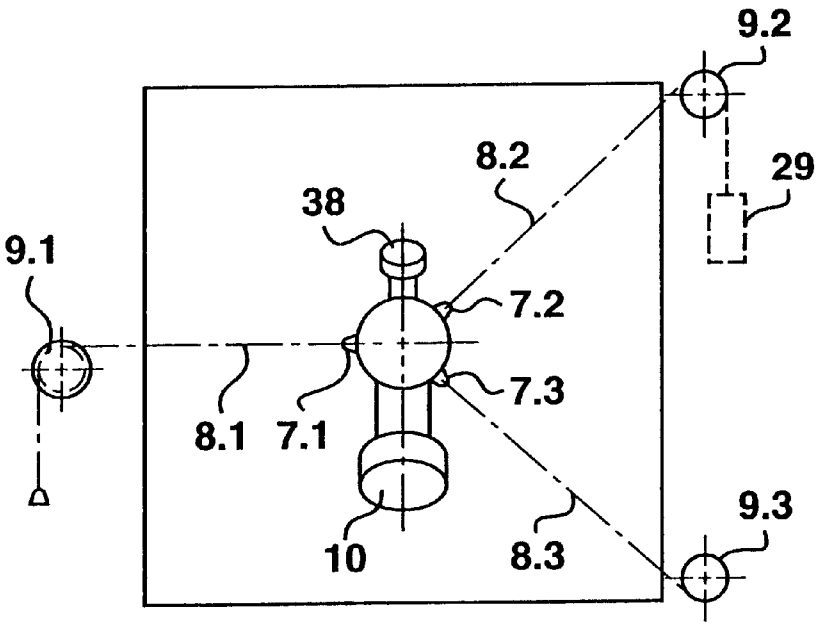

The embodiment shown in FIGS. 12 and 13 shows schematically how water lance blowers can be protected and cooled by means of a protective sleeve using blocking and flushing air and, for example, can be moved by three cable-type movement elements.

In the wall 1 of the heating installation there is located the hatch 2 with angled pieces towards the inside 3 and the outside 4. In the hatch 2 the movement point 5 is installed in a fixed manner and is configured as the front swivel bearing for the water lance 6 fixed in the centre. The water lance 6 is provided at the rear end with fixing points 7.1, 7.2, 7.3 in which the lance-side ends of the movement elements 8.1, 8.2, 8.3 are rotatably mounted. The rearward ends of the movement elements are rotatably integrated into the locating bearings 9.1, 9.2 9.3. The entry of water into the lance 6 takes place via a connector 10 and a water supply 11 in the form of a pressure resistant flexible hose. The non-rotatable but flexibly bendable mountings 7.1–7.3, which are not shown in more detail, retain stable but flexible cables which act as movement elements 8.1–8.3. The cables run on the locating bearings 9.1–9.3 over rollers or are wound/unwound on these rollers. With a further configuration there is located on the end of the cable of the movement element 8.2 a counter weight 29 (shown in broken lines). The rollers are provided with drives 25.1–25.3 with their supports. The hatch 2 is delimited by a connecting box 30. The outside edge of the connecting box is sealed by means of a housing 31 to the lance 6 and forms a clear interior 32 flowed through with air. The lance 6 with its nozzle 33 is provided at the end with an inlet 34. The lance is surrounded by an outer pipe 35. The outer pipe is provided with a separating ring 36 which in the forward area forms an air sheath 37 with air supply 38 and in the rear part a water deflector 39 which opens out into the water connector 10.

Blocking and flushing fluid, preferably air, can flow via apertures 40 from the air sheath 37 into the valve head of the lance 6 and via apertures 41 into the interior 32. With this solution the 3 movement elements 8.1–8.3 are controlled by tractive forces alone. Torsional forces caused by the spatial movement of the movement elements are particularly compensated for with a cable, as is represented by rolling apparatus 42 on the locating bearing 9.3. In another solution, rollers and cables are replaced by chain and a chain wheel. With this solution the chain can hang down freely at the free end as shown on the locating bearing 9.1.

With a further solution, a movement element as shown here in broken lines as 8.2 is not equipped with a drive and the necessary tensile stress is produced by means of a roller 9.2 and counter weight 29.

With these solutions the air and water supply can be accommodated in a sheath pipe, the air and water supply hanging free, arranged in a perpendicular plane, without the movement elements and air and water supply impeding one another during the pivoting positions. By using narrow cables as movement elements, which also need only small mountings 7.1–7.3 there is sufficient space for the lance between the housing 31 and lance outer pipe 35, even at maximum inclination of the lance, when mountings swivel, as a requirement of the design, into the outside angled piece 4. In this case the lance can be further shortened.

The outer pipe 35 with the connecting hemisphere as the deflector 39 provides equalised inflow conditions of the water into the lance and ensures that despite having a short lance there is a twist-free jet of water with a low degree of fanning out.

Naturally all the technical solutions described can be linked together in any manner, in particular this applies to the selection and combination of the technology of the movement elements and their dynamic effect on the traction and/or pressure and the arrangement of the mountings at different distances from the point of rotation 0 of the lance, variations of them as a ball joint, tongue, eyelet, joint, universal joint or rigid connection with a flexible junction, the various selection of different lengths of the movement elements and variable locations for the locating bearings. The selection of the method for controlling the blowing patterns and the programming thereof can be linked together in any manner between the experimental measuring technology and mathematic programming technology solution. In this way, using measuring technology or experimentally by means of the jet geometry, the lance guidance in the heating installation can be lengthened, geometrical comer points, for example, maximum top/bottom, right/left and so forth determined, these input into a mathematical program, and afterwards the further path points calculated for the blowing patterns.

A further variation is in that blowing operations not previously effected with other solutions can be blown with different path speeds, so that very clinkered places can be blown for longer and/or instead of the switching on/off of the water supply valves, without interruption of the blowing operation at high speed from the end point E to the starting point A of the next blowing pattern (see FIG. 3).

By means of the invention the following advantages occur:

a. The method ensures the variable performance of any blowing patterns, it is not primarily linked to the geometry of the conventional movement elements with horizontal and/or vertical movements altering by 90°, circular or spiral movements. The direction, deflection and speed can be varied as desired and individually adjusted to the cleaning requirements.

b. There are no limitations with respect to the site of installation of the water lance blower.

Obstructed hatches, lack of space and other spatial obstacles can moreover be used for the installation of suitable water lance blowers by variation of the arrangement and length of the movement elements, with individual selection of the fixed point and mountings on the lance. In this way an optimum selection can be made for the arrangement of the water lance blower in the heating installation, and the total number of water lance blowers on the installation minimised.

c. The amount of material used, space requirement and weight of the water lance blower are minimised. In particular the bearings and drives fitted in a stable, large frame are omitted, and the spindles, chains and guides of the previous solutions. Mounting is simplified.

d. The availability of material is significantly more flexible, as there is no requirement for fixed measurements of construction elements. The commercially available solutions for movement elements, for locating bearings and control elements can be used.

e. Where there are defects, when components are replaced constructional deviations can be allowed for when the setting-up of the blowing patterns is adjusted.

f. The measurements of the water lance blower, in particular towards the rear and at the side are reduced. In this way access and installation is possible even to small platforms.

g. The water supply is simplified and less prone to breakdowns because of smaller pivot paths and the omission of bends.

While the particular embodiments for water lance blowers as herein shown and disclosed in detail are fully capable of obtaining the objects and advantages herein before stated, it is to be understood that they are merely illustrative of the presently preferred embodiments of the invention and that no limitations are intended by the details of construction or design herein shown other than as described in the appended claims.

LIST OF DESIGNATIONS

1 wall
2 hatch
3 inside angled piece
4 outside angled piece
5 movement point, ball joint
6 water lance
7.1–7.3 fixing points on the water lance
8.1–8.3 movement elements
9.1–9.3 fixing points on the heating installation
10 water connection
11 water supply
12 first support
13 steam pipe
14 second support
15 grating floor
16,17 rails
18 switchgear cupboard, control cupboard
19 outer skin of the heating installation
20 spherical container, water guide
21.1–21.3 upper arm
21.1–22.3 lower arm
23.1–23.3 spindle
24 deflector
25.1–25.2 drives
26.1–26.2 cable connections
27 frame
28 operative
29 counter weight
30 connection box
31 housing
32 interior of housing
33 nozzle
34 inlet
35 outer pipe
36 separating ring
37 air sheath
38 air supply
39 water deflector
40,41 apertures
42 rolling apparatus
43 hose clamp
ΔAlpha change in angle of rotation
ΔL change in path
A beginning
E end
S working area
r right
l left
o top
u bottom
X,Y,Z coordinates
G limit point
B furnace aperture
R gas recirculation aperture

What is claimed is:

1. A water lance blower for cleaning a heating installation having wall areas and a hatch, wherein the heating installation is operational with flames and/or smoke flowing therethrough, said water lance blower comprising:

a water lance having a mouth, wherein the water lance is pivotable in a vertical range and a horizontal range and is arranged with the mouth at the hatch for blowing a water jet through the heating installation onto the wall areas which can be reached from the hatch, wherein the water lance is configured in a shortened manner; and a water supply which supplies water to said water lance, wherein said water supply comprises at least one first bend, wherein the at least one first bend is at least 70°.

2. A water lance blower according to claim 1, wherein the at least one first bend is at least 90°.

3. A water lance blower according to claim 1, wherein, at an end of the water lance lying outside the heating installation, the water lance comprises an expanded calming container.

4. A water lance blower according to claim 3, wherein the expanded calming container comprises an approximately spherical container for the water being supplied.

5. A water lance blower according to claim 1, wherein said water supply is in an area close to a wall near a movement point of said water lance, wherein the at least one first bend of said water supply is between about 90° and about 150° and said water supply further comprises, adjacent the at least one bend, a piece which runs approximately parallel to the water lance and has a flow direction counter to the direction of the flow of the water lance, wherein the piece opens into a calming container via a second bend of between about 90° and about 180°.

6. A water lance blower according to claim 1, wherein said water supply is in an area close to a wall near a movement point of said water lance, wherein the at least one first bend of said water supply is between about 90° and about 150° and said water supply further comprises, adjacent the at least one bend, a piece which runs approximately parallel to the water lance and has a flow direction counter to the direction of the flow of the water lance, wherein the piece opens into said water lance via a second bend of between about 90° and about 180°.

7. A water lance blower according to claim 1, further comprising movement elements for moving said water lance, wherein said water supply is approximately parallel to a wall of the heating installation and is between the movement elements.

8. A water lance blower according to claim 1, further comprising at least one movement element which is fixed at one end to an installation fixing point and fixed at another end to said water lance.

9. A water lance blower according to claim 8, wherein the at least one movement element comprises at least three movement elements which are each fixed at one end to an installation fixing point and which are each fixed at the other end to said water lance at a water lance fixing point, wherein the installation fixing points are arranged around a movement point of the water lance at angles of between about 80° and about 140°.

10. A water lance blower according to claim 8, wherein the at least one movement element comprises at least one path sensor which measures an actual position of the at least one movement element with respect to a reference position.

11. A water lance blower according to claim 10, wherein the at least one path sensor comprises sensors for determining the actual position of the water lance.

12. A water lance blower according to claim 10, wherein the at least one movement element and the at least one path sensor are connected to a shared electronic control system, wherein the control system calculates an actual position of the water lance from measured values of the at least one path sensor and provides control commands to the at least one movement element, wherein courses of movement of the water lance are repeatable in relation to the path of travel and speed.

13. A water lance blower according to claim 8, wherein the at least one movement element comprises a cylinder selected from a hydraulic lifting cylinder and a pneumatic lifting cylinder which is fixed at one end to an installation fixing point and fixed at another end to a part of the water lance outside the heating installation.

14. A water lance blower according to claim 8, wherein the at least one movement element is a drive selected from a spindle drive and rack and pinion drive, which is fixed at one end to an exterior wall of the heating installation and fixed at another end to a part of the water lance outside the heating installation.

15. A water lance blower according to claim 10, wherein the at least one path sensor is a sensor selected from an angle sensor and a length sensor.

16. A water lance blower according to claim 10, further comprising at least one additional path sensor in addition to the at least one past sensor which is necessary for determining the position of the water lance, in order to increase precision of positioning.

* * * * *